United States Patent [19]

Lyon et al.

[11] 4,024,001

[45] May 17, 1977

[54] SMOKE FILTER PROCESS AND APPARATUS

[75] Inventors: Henry Lyon, Bletchley; Stanley William Byrne, Milton Keynes, both of England

[73] Assignee: American Filtrona Corporation, Richmond, Va.

[22] Filed: Sept. 12, 1975

[21] Appl. No.: 612,922

[30] Foreign Application Priority Data

Sept. 19, 1974 United Kingdom ..... 40953/74

[52] U.S. Cl. ..... 156/180; 93/1 C; 93/77 FT; 156/209; 156/305; 156/441; 156/582; 264/DIG. 48; 264/284

[51] Int. Cl.[2] ..... A24C 5/50

[58] Field of Search ..... 156/180, 181, 207–209, 156/436, 433, 497, 441, 198, 583, 582, 296, 290, 306, 305, 307; 28/1 CF; 428/296; 93/1 C, 77 FT; 131/10.5, 261, 265, 10.3, 10.7, 267; 264/DIG. 48, 168, 258, 284

[56] References Cited

UNITED STATES PATENTS

| | | | |
|---|---|---|---|
| 3,095,343 | 6/1963 | Berger | 156/180 |
| 3,164,157 | 1/1965 | Lebert | 131/10.3 |
| 3,478,141 | 11/1969 | Dempsey et al. | 264/284 |
| 3,510,389 | 5/1970 | Olson | 428/296 |
| 3,697,347 | 10/1972 | Lehmann | 156/181 |
| 3,752,166 | 8/1973 | Lyon et al. | 131/10.5 |
| 3,826,177 | 7/1974 | Berger et al. | 93/1 C |
| 3,847,064 | 11/1974 | Berger | 93/1 C |

FOREIGN PATENTS OR APPLICATIONS

| | | |
|---|---|---|
| 1,333,434 | 10/1973 | United Kingdom |

*Primary Examiner*—Douglas J. Drummond
*Assistant Examiner*—Michael W. Ball

[57] ABSTRACT

The invention provides a process for the continuous production of an elongate smoke filtering member comprising a heat-activatable bonding material and having air-permeable deformations at longitudinally displaced positions along its length, which comprises continuously advancing longitudinally a rod-like body of the material of the member, intermittently passing a hot fluid laterally into the advancing body to activate the bonding material substantially only at separate longitudinally displaced regions of the body, and deforming the outer surface of the advancing body at such regions where the bonding material is activated. Apparatus for performing the method comprises means for continuously longitudinally advancing the rod-like body, means for passing a hot fluid laterally into the body at regions longitudinally displaced along the body, and means for deforming the outer surface of the body at said regions.

12 Claims, 4 Drawing Figures

SMOKE FILTER PROCESS AND APPARATUS

Figure 1:
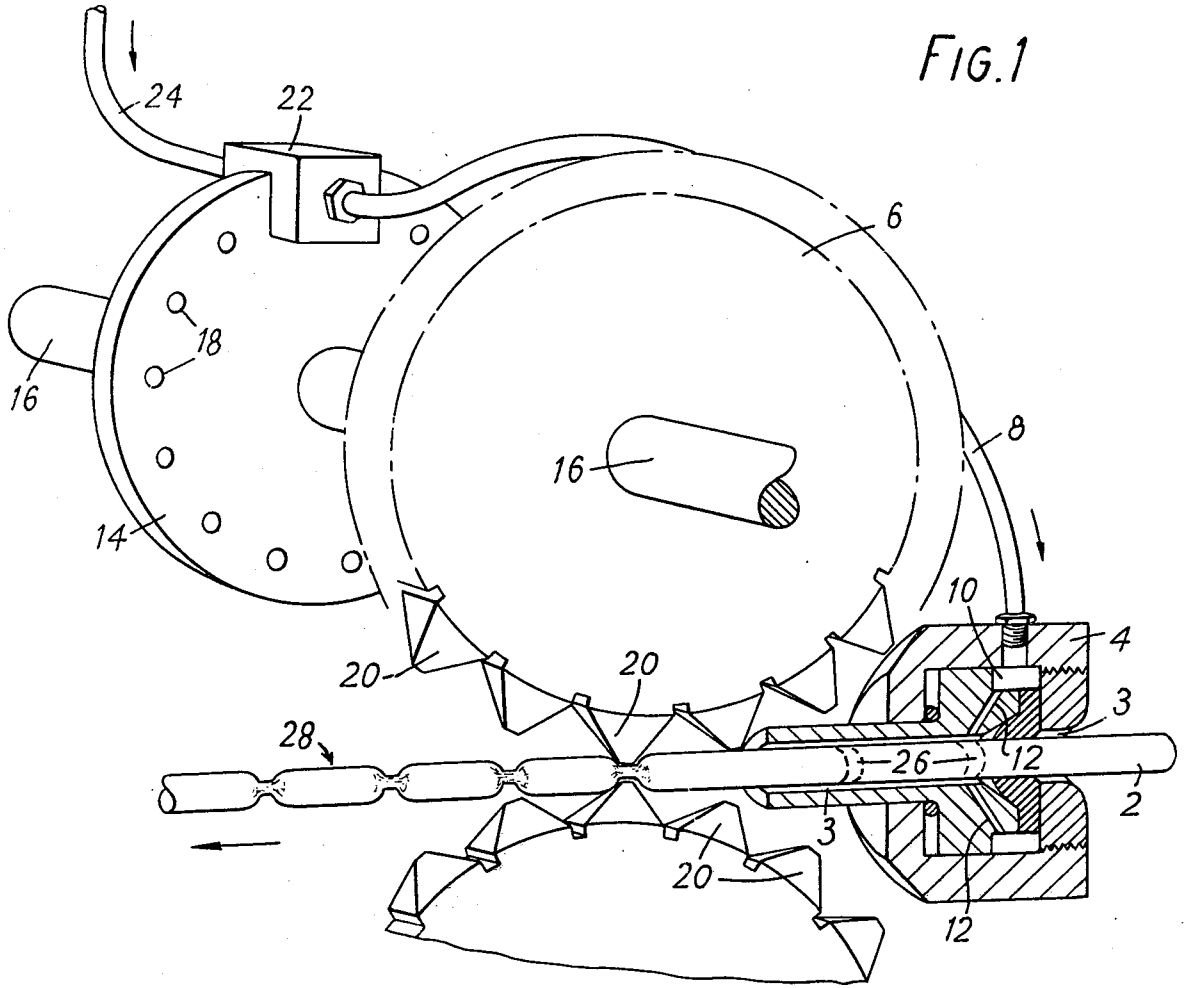

This invention relates to a continuous process, for the production of an elongate smoke filtering member comprising a heat-activatable bonding agent, of the type in which a continuously longitudinally advancing rod-like body of the material of the member, heated by the passage thereinto of a hot fluid, e.g. steam, has its outer surface deformed at longitudinally displaced positions and is then cooled to yield the coherent elongate member having permanent deformations at the said longitudinally displaced positions, at least a portion of the surface of the deformed regions being air-permeable.

Such deformed elongate filtering members are for example employed in the production of tobacco smoke filter rods in which a filtering inner member comprising a length cut from the elongate member has a surrounding outer wrapper, usually of smoke-impermeable material; the outer wrapper is engaged with the inner member to prevent the passage of smoke unfiltered between the ends of the composite filter rod; the deformations in the surface of the inner member provide spaces between the inner and outer members, and smoke drawn through such a composite rod passes between such a space and the material of the inner filtering member through the air-permeable surface of the deformed region.

In prior procedures, for inwardly deforming the surface of a heated rod-like body in the manufacture of smoke filtering elements, it has been the practice to heat the whole of the rod-like body by the passage of the hot fluid thereinto; for example the hot fluid such as steam is passed continuously laterally into a tubular former through which the rod-like body is continuously advancing, the former maintaining the material of the body in (or shaping it to) the required tubular or rod form.

According to the present invention, the heating fluid is applied to the rod-like body substantially only at the regions where deformation occurs. In one embodiment, for example, the rod-like body is advanced continuously through a tubular former having a steam port or ports in its tubular wall, and then to and through a deforming chamber wherein a deforming member or members (e.g. a projection or projections on a crimping wheel or wheels) move into the path of the advancing body to form the spaced depressions in its surface, the or each port being appropriately aligned with the corresponding deforming member or members when in deforming position; an interruptor for the steam supply to the port or ports is provided, and is operated in synchronism with the movement of the deforming member or members so that steam is supplied intermittently through the port or ports to heat the body substantially only in those positions where it is subsequently contacted and inwardly deformed by the deforming members. In another embodiment, the heating and deforming are carried out in a single step, the steam being supplied through a port or ports in a face of the or each deforming member; an interruptor for the steam supply is provided and operated so that steam is supplied through a deforming member to heat the body substantially only during the period or a part of the period during which the member is in deforming contact with the body.

Accordingly the invention provides a process for the continuous production of an elongate smoke filtering member comprising a heat-activatable bonding material and having air-permeable deformations at longitudinally displaced positions along its length, which comprises continuously advancing longitudinally a rod-like body of the material of the member, intermittently passing a hot fluid laterally into the advancing body to activate the bonding material substantially only at separate longitudinally displaced regions of the body, and deforming the outer surface of the advancing body at such regions where the bonding material is activated. Apparatus for performing the method comprises means for continuously longitudinally advancing the rod-like body, means for passing a hot fluid laterally into the body at regions longitudinally displaced along the body, and means for deforming the outer surface of the body at said regions. Important advantages of the invention are that it permits the formation of depressions or other deformations having greater accuracy of shape and size; and that it reduces or eliminates distortion of the surface between the regions where the intended deformation occurs, thus facilitating better engagement between these intermediate surface regions and a subsequently applied outer wrapper and hence improving the performance and uniformity of individual elements cut from the wrapper member.

The rod-like body may be in the form of a rod or a tube, depending upon the type of filtering member to be made. The deformation may be performed to yield an elongate member having regions of reduced cross-section at longitudinally spaced positions along its length, with undeformed regions therebetween, and maybe superficial or such as to provide seals inhibiting or preventing the longitudinal passage of smoke through the body of the filtering material at spaced intervals. Rod and tube shapes which may be obtained according to the invention include for example those described and illustrative in U.K. Patent Specifications Nos. 1,263,154; 1,282,132; 1,318,113 and 1,308,611.

The method of the invention is particularly applicable to the formation of elongate fibrous filtering members, though it is more generally applicable. The material for the production of the elongate member may be a fibrous smoke filtering material, e.g. cellulose acetate, together with a solvent plasticiser or a particulate thermoplastic which acts as the bonding material. The filtering material may be or include thermoplastic fibres, in which case the inclusion of a separate bonding material may not be necessary. The preferred material is filamentary cellulose acetate with a solvent plasticiser such as triacetin.

The process of the invention is preferably applied to performed bonded rods or tubes, made for example in the manner described in U.K. Patent Specification No. 1,169,132, to which attention is directed for full detail. The undeformed rod or tube made by such methods will normally be passed directly and continuously to the intermittent heating and deforming stages of the present invention. The deformed elongate member produced according to the invention will normally be cooled, e.g. by injection of air, following the deformation step, in the manner disclosed for example in U.K. Patent Specification Nos. 1,263,154 and 1,282,132, in order to set the deformed member permanently in its final form.

For the production of composite smoke filter elements of the type previously referred to, the continuously produced deformed elongate filtering member is usually continuously wrapped in and engaged with the outer wrapper, and the resulting composite filter rod is severed transversely, at and/or between the positions of deformation, to yield the individual filter elements — or multiple length rods which are subsequently cut into individual lengths, e.g. when applied to cigarettes on a cigarette-making machine. A variety of different such types of filter elements, the multiple length members from which they are made, and processes and apparatus for their manufacture are described for example in U.K. Patent Specifications Nos. 1,263,154; 1,282,132; 1,318,113 and 1,308,611 to which attention is directed for full details.

Of commercial importance is the tubular type of filter disclosed in U.K. Patent Specification No. 1,263,154 made by deforming a tube of filtering material to bring the inner surface of the tube into engagement at longitudinally spaced intervals, enwrapping the deformed tube in an impermeable wrapper, and then cutting the enwrapped deformed tube transversely at and/or between positions of deformation.

Figure 2:
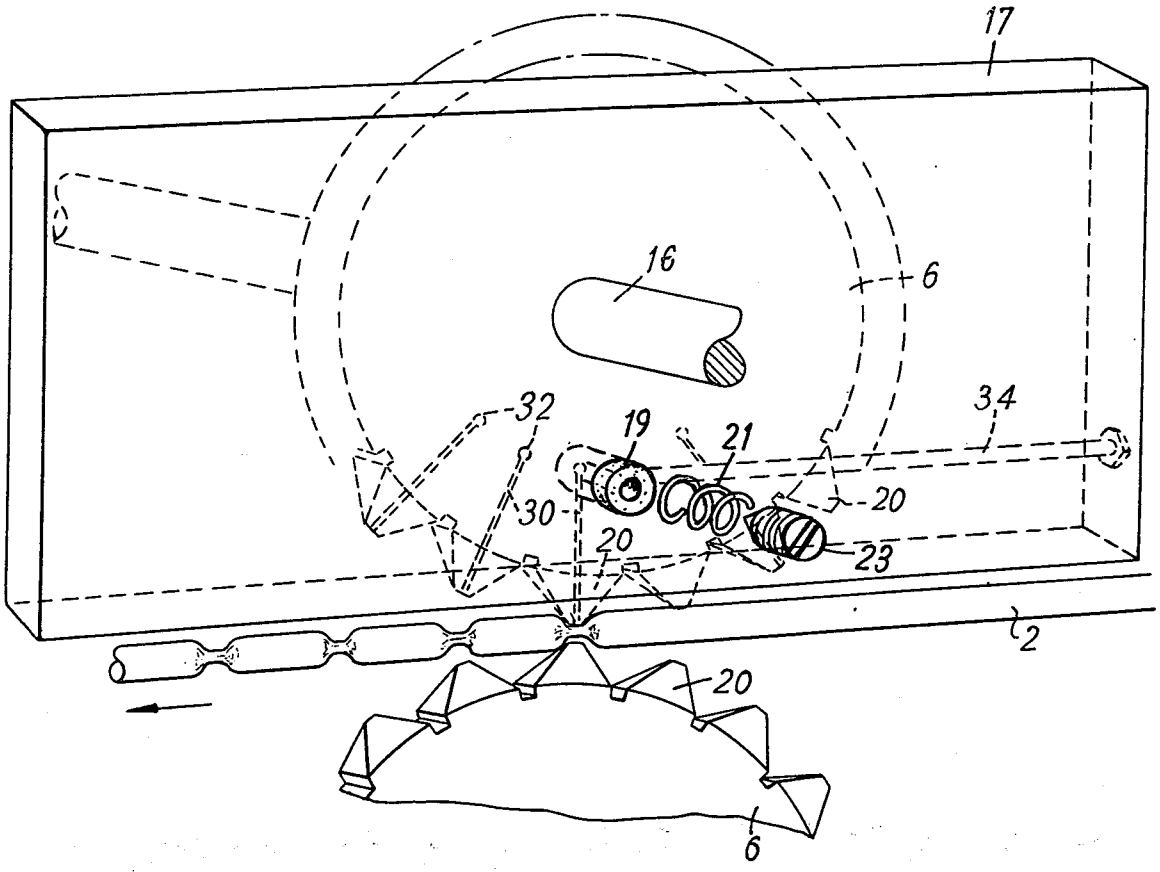
Figure 3:
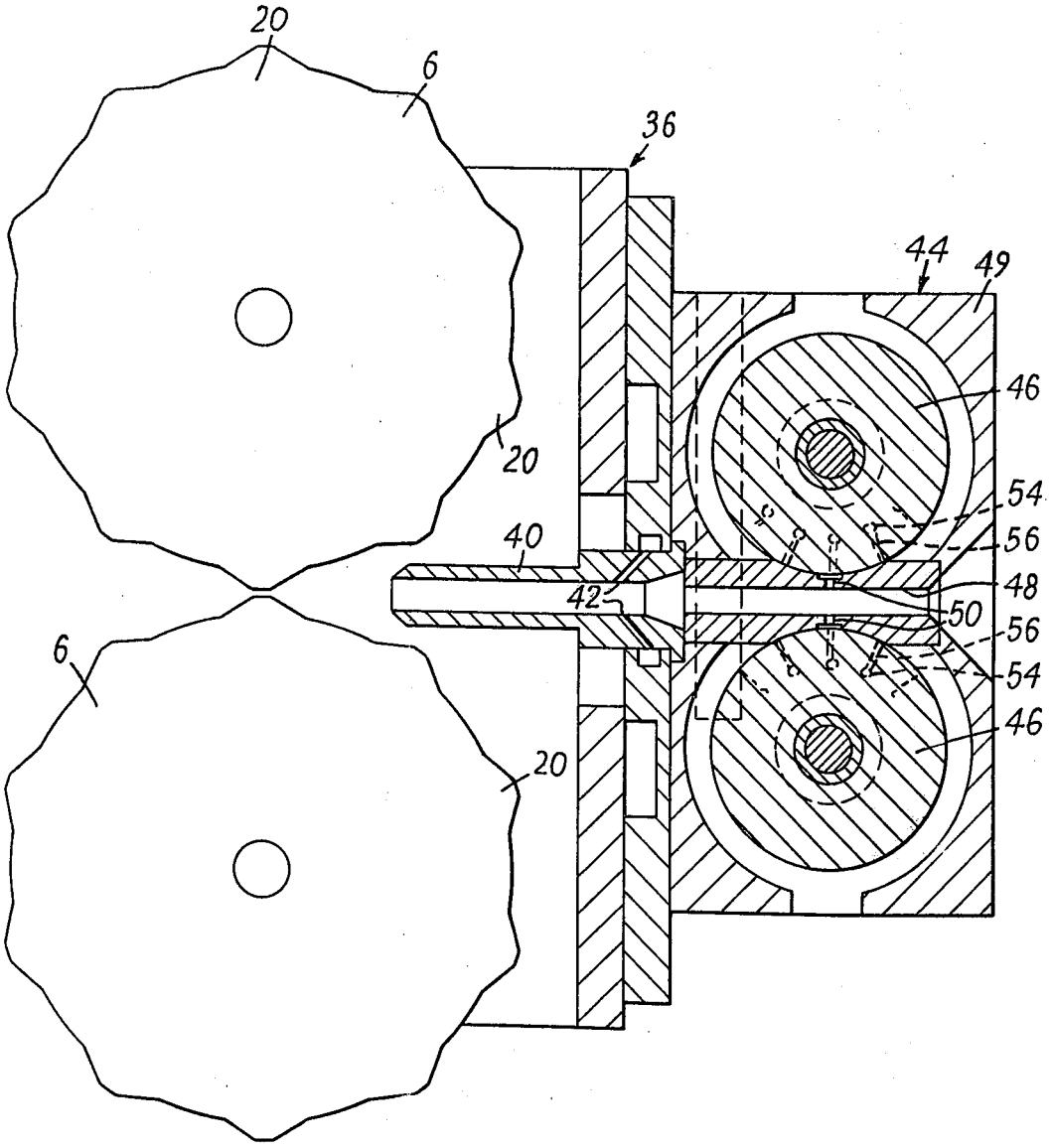
Figure 4:
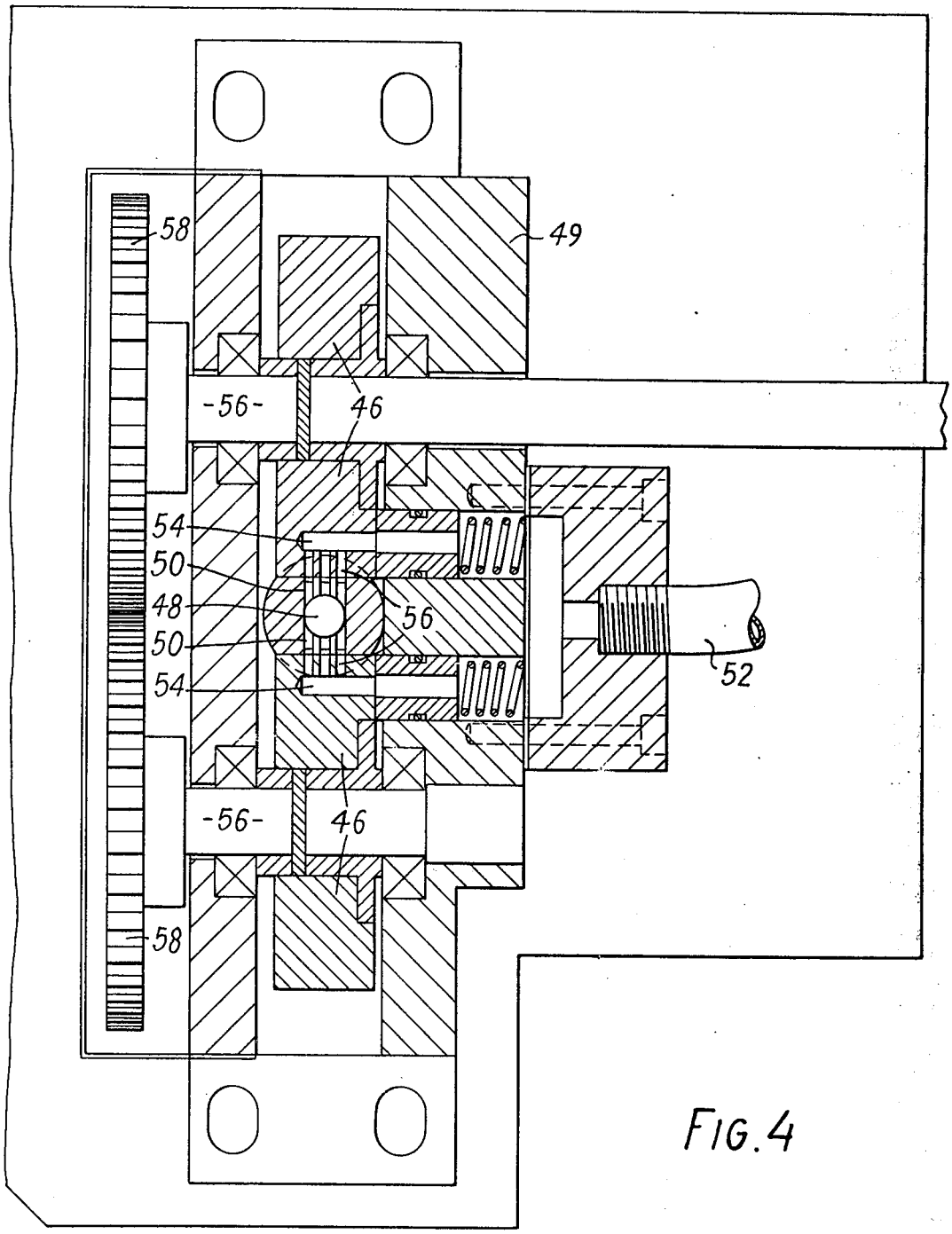

Embodiments of the process and apparatus according to the invention will now be described, by way of example only, with reference to the accompanying drawings, in which:

FIG. 1 is a partial diagrammatic perspective view, partially in section, illustrating the essential features of a first embodiment, FIG. 2 is a similar view of a second embodiment, FIG. 3 is a side elevation view, partly in section, of a third embodiment of an apparatus according to the invention, and FIG. 4 is an end elevation view, mainly in section, of the apparatus of FIG. 3.

In the embodiment of FIG. 1, a continuous cylindrical filtering rod or tube 2, e.g. of bonded cellulose acetate filaments, is advanced continously through a tubular passage 3 of a stream nozzle 4 and then between a pair of heated co-operating rotating crimping rollers 6 in the direction indicated by the arrow. Steam is supplied to nozzle 4 by pipe 8, the steam issuing from pipe 8 into a chamber 10 in the nozzle and then passing via the two diametrically opposed ports 12 into the tubular passage 3. The two crimping wheels 6 are driven in unison by means not shown, and a disc 14 is mounted on the same shaft 16 as one of the wheels 6 for rotation in unison therewith, the disc having holes 18 through its periphery, one for each crimping tooth 20 on a wheel. Mounted stationarily astride the rim of the disc is a steam box 22 from which pipe 8 leads on one side of the disc and into which pipe 24, fed continuously with steam from a source not shown, leads on the opposite side of the disc. The two pipes 8 and 24 extend to the respective opposed faces of the disc and are positioned so as to be brought intermittenly into communication via holes 18 during rotation of the disc; the ends of pipes 8 and 24 within box 22 have end-pieces of Teflon or the like which are spring-loaded into sliding contact with the respective faces of disc 14, thus being substantially steam-tight. As the rod or tube 2 is advanced and the wheels 6 and disc 14 are rotated in unison, steam is supplied to the rod or tube via ports 12 only intermittently, so that the rod is heated and rendered deformable only over longitudinally spaced regions 26, and the holes 18 are so aligned relative to teeth 20 that the teeth deform the rod or tube only at these heated and softened regions, to yield the elongate filtering member 28 having regions of reduced cross-section alternating longitudinally with substantially undeformed regions. The member 28 is preferably fed directly to an air-cooling station and then continuously enwrapped and cut as described in U.K. Patent Specification No. 1,263,154 or 1,282,132. The rod 2 may for example be one produced as in U.K. Patent Specification No. 1,169,132 and fed directly and continuously to the nozzle 4 from the air-cooling station described therein.

In the embodiment of FIG. 2, heating and deformation occur simultaneously. The rod or tube 2 is advanced continuously between the crimping wheels 6 in the direction of the arrow. Each crimping tooth 20 of each wheel has a steam conduit 30 extending from its radially outermost face, through the body of the wheel to an inlet 32 at one face of the wheel, the inlets 32 defining a circle centred on wheel shaft 16 journalled in bearing block 17. A steam pipe 34, continuously fed from a source not shown, leads to the inlet of an annular pressure pad 19 which is disposed against the face of the wheel so that its outlet comes into communication with the successive inlets 32 as the wheel rotates. Pressure pad 19, e.g. of Teflon, is spring-loaded against the face of wheel 6 by spring 21 and pressure screw 23, pad 19, spring 21 and screw 23 being illustrated for clarity in exploded view; the arrangement is thus steam-tight. Thus steam is delivered through each conduit 30 only as its respective tooth comes into deforming contact with the rod or tube 2, which is hence heated and softened only at the positions of deformation. The source and nature of rod or tube 2 and the subsequent treatment of product 28 may be as described for the FIG. 1 embodiment.

It will of course be understood that both wheels 6 of FIGS. 1 and 2 are substantially identical with one another, the lower wheel shown in FIG. 2 being supplied with steam in the same manner as the upper wheel, and both wheels of each embodiment being provided with crimping teeth around the whole of their respective peripheries. It is possible to employ three or more (e.g. (four) co-operating crimping wheels instead of the pair illustrated in FIGS. 1 and 2, according to the nature of the deformation to be made; and separate sets of deforming members can be employed to operate on respective separate regions of the rod or tube, e.g. where longitudinally and circumferentially spaced depressions are required as in U.K. Patent Specification No. 1,318,113.

FIGS. 3 and 4 illustrate in greater detail a deforming and intermittent heating process and apparatus according to the invention. The apparatus includes equipment 36 which is standard in the commercial production of deformed tubular filter members in the manner of U.K. Patent Specification No. 1,263,154, this equipment comprising a pair of cooperating crimping wheels 6 with crimping teeth 20, and a steam application tube 40 for delivering and guiding the rod-like body to the crimping wheels; for the purpose of this invention, this standard equipment is modified in that the tube 40 serves merely as a guide, no steam being supplied through the ports 42, and by the addition of intermittent steaming means indicated generally at 44.

The intermittent steaming unit comprises a pair of steam application wheels 46 which rotate in unison and deliver steam intermittently to the interior of tube 48 via ports 50 extending through the tube wall, the whole being mounted in a metal (e.g. brass) block 49. Steam from inlet 52 (FIG. 4) passes to the interior of each wheel 46 via respective ducts 54, from which radial ducts 56 lead to the rim of the wheel. As the wheels rotate, successive ducts 56 come into communication with their corresponding port 50 to deliver steam intermittently to the interior of tube 48. Wheels 46 are driven in unison on their shafts 56 by meshing gear wheels 58 one of which is driven by means not shown, and the disposition of radial ducts 56 in the wheels 46 is such that steam is delivered simultaneously through the two opposed ducts 50. Accordingly a rod or tube of smoke filtering material which comprises a heat-activatable bonding material, advancing continuously through tube 48 (preferably of polytetrafluoroethylene or the like) towards the crimping wheels 6, has steam injected thereinto only at spaced regions along its length, and the rotation of the crimping wheels 6 is synchronised so that their teeth 20 come into deforming contact with the rod or tube only at such regions where the tube or rod has been so heated and softened.

It is evident that the apparatus illustrated in FIGS. 3 and 4, which involves the attachment of intermittent steaming unit 44 to a standard heating and crimping or deforming unit 36, could be modified by omitting tube 40, or its port 42, the intermittently heated rod or tube being fed directly to the crimping wheels from an intermittent steaming unit 44.

As in the embodiments of FIGS. 1 and 2, the deformed elongate member produced by the process and apparatus of FIGS. 3 and 4 will normally be passed directly and continuously to respective means for cooling, enwrapping and then cutting the member into lengths in the member described in U.K. Patent Specification Nos. 1,263,154 and 1,282,132. Similarly the cylindrical rod or tube fed to the intermittent steaming unit may be one which can be produced by the methods disclosed in any of the above-mentioned cases for the formation of such tubes and rods and preferably the formation of the rod or tube, its heating and deformation according to this invention, and the conversion of the deformed product into individual or multiple filter elements, is conducted in a continuous uninterrupted operation.

Whilst emphasis is laid above on the use of steam as heating medium, especially where cellulose acetate is employed in the fabrication of the elongate member, any hot fluid which activates the bonding component without destroying or markedly impairing the ultimate filtering properties of the product filter may be employed. Steam, however, is much preferred.

Furthermore, whilst the above embodiments illustrate the use of a pair of opposed crimping wheels for effecting deformation, it is of course possible to employ other types of deforming members to give other configurations at the positions of deformation, and a variety of suitable means for deformation, and deformed configurations obtainable, are referred to and described in the above-mentioned earlier specifications and in U.S. Pat. Nos. 3,690,326; 3,648,711; 3,703,429; 3,637,447; 3,599,646 and 3,533,416.

We claim:

1. A process for the continuous production of an elongate smoke filtering member having air-permeable deformations at longitudinally displaced positions along its length, which comprises continuously advancing longitudinally a rod-like body of a heat-activated bondable filtering material, intermittently passing a hot fluid laterally into the advancing body in an activating zone to activate the bondable filtering material substantially only at separate longitudinally displaced regions of the body while precluding the passage of the hot fluid into contact with the bondable filtering material at other regions, and deforming the outer surface of the advancing body at such regions where the bondable filtering material is activated.

2. A process according to claim 1 wherein the rod-like body is advanced continuously first through a tubular activating zone in which the hot fluid is intermittently passed thereinto at said longitudinally displaced regions, and then to and through a deforming zone wherein the rod-like body is provided with spaced depressions in its surface at locations corresponding to said regions, the passage of hot fluid and the formation of spaced depressions being synchronized at the same locations.

3. A process according to claim 1 wherein the heating and deforming are carried out in a single step, the hot fluid being supplied through the face of means for deforming the rod-like body to provide the same with spaced depressions, the supply of hot fluid being operated so that the fluid is supplied through the face of the deforming means substantially only during the period or a part of the period in which the deforming means is in a deforming contact with the rod-like body.

4. A process according to claim 1 wherein the rod-like body is a solid rod of filtering material.

5. A process according to claim 1 wherein the rod-like body is a hollow tube of filtering material.

6. A process according to claim 1 wherein the deformation of the rod-like body is superficial.

7. A process according to claim 1 wherein the deformation of the rod-like body provides seals inhibiting or preventing the longitudinal passage of smoke through the body of the filtering material at spaced intervals.

8. A process according to claim 1 wherein the rod-like body is of fibrous filtering material.

9. A process according to claim 1 wherein the hot fluid is steam.

10. Apparatus for the continuous production of an elongate smoke filtering member having air-permeable deformations at longitudinally displaced positions along its length comprising means for continuously longitudinally advancing a rod-like body of heat-activated bondable filtering material, means defining an activating zone, means for passing a hot fluid laterally into the advancing body in said activating zone at regions longitudinally displaced along the body to activate the bondable filtering material substantially only at separate longitudinally displaced regions of the body while precluding the passage of the hot fluid into contact with the bondable filtering material at other regions, and means for deforming the outer surface of the advancing body at said regions where the bondable filtering material is activated.

11. Apparatus according to claim 10 wherein said means defining said activating zone and said means for deforming are spaced from each other along the path of travel of the rod-like body.

12. Apparatus according to claim 10 comprising crimping wheel means having deforming surfaces defining said means for deforming, means defining a source of the hot fluid, port means for the hot fluid extending to and through said deforming surfaces of said crimping wheel means, and an interrupter means interposed between said source of the hot fluid and said deforming surfaces operable to supply the hot fluid through said port means of a deforming surface only during its contact with the advancing body.

* * * * *